US006641278B1

(12) United States Patent
Guritz

(10) Patent No.: US 6,641,278 B1
(45) Date of Patent: Nov. 4, 2003

(54) LIGHTING FIXTURE ATTACHMENT MEANS

(76) Inventor: Michael Lee Guritz, 8903 51st Ave. W., Bradenton, FL (US) 34210

( * ) Notice: Subject to any disclaimer, the term of this patent is extended or adjusted under 35 U.S.C. 154(b) by 23 days.

(21) Appl. No.: 10/095,128

(22) Filed: Mar. 11, 2002

Related U.S. Application Data

(60) Provisional application No. 60/274,737, filed on Mar. 10, 2001.

(51) Int. Cl.[7] ..... F21V 21/02

(52) U.S. Cl. ..... 362/148; 362/147; 362/404; 362/260

(58) Field of Search ..... 362/147, 148, 362/149, 368, 404, 260, 217

(56) References Cited

U.S. PATENT DOCUMENTS 4,302,798 A * 11/1981 Sit ..... 362/147
4,821,161 A * 4/1989 Koontz ..... 362/364
4,929,187 A * 5/1990 Hudson et al. ..... 439/334
5,568,969 A * 10/1996 Yu ..... 362/404
6,257,743 B1 * 7/2001 Ursch ..... 362/418

* cited by examiner

*Primary Examiner*—Laura K. Tso
(74) *Attorney, Agent, or Firm*—Dorothy S. Morse

(57) ABSTRACT

Apparatus, and a method for its use, that addresses the installation and maintenance of wall-mounted and ceiling-mounted light fixtures that otherwise would be partially assembled on-site during installation and use the industry-standard fixture bar, threaded nipple, lock nut(s), push nuts, and multiple screws. The present invention provides a factory assembled lighting fixture that includes a clutch ring, and is installed using a fixture bar, two screws, and a probe with a slotted distal end. Once the fixture bar and probe are attached to a junction box, and wiring terminations are made, the clutch ring attached to the fully assembled lighting fixture is simply pushed over the distal end of the probe to achieve secure and immediate installation. Thus, in commercial and industrial applications, although not limited thereto, use of the present invention would substantially reduce the time required for lighting fixture installation.

20 Claims, 5 Drawing Sheets

PRIOR ART

LIGHTING FIXTURE ATTACHMENT MEANS

BACKGROUND—RELATED APPLICATIONS

This application is based upon U.S. provisional patent application 60/274,737, filed on Mar. 10, 2001, by the same inventor for the same invention, and the inventor respectfully requests all benefit to which he is entitled from this provisional patent application.

BACKGROUND—FIELD OF INVENTION

This invention relates to devices used for the installation of lighting fixtures, specifically to apparatus, and a method for its use, that addresses the installation and maintenance of wall-mounted and ceiling-mounted light fixtures that otherwise would be partially assembled on-site during installation and employ the industry-standard fixture bar, threaded nipple, lock nut(s), wire nuts, and screws. In contrast, the present invention provides a fixture bar, a clutch ring, and a probe with a slotted distal end that are used to promptly mount a factory assembled lighting fixture. Therefore, once the fixture bar and probe are attached to a junction box, and wiring terminations are made, the clutch ring incorporated into the back of the fully assembled lighting fixture is simply pushed over the distal end of the probe to achieve secure installation. Although not limited thereto, commercial and industrial applications are both contemplated.

BACKGROUND—DESCRIPTION OF PRIOR ART

Installation of lighting fixtures using the industry-standard method is time consuming. It involves at least four steps that include partial assembly of the lighting fixture on site. A fixture bar is first attached to the junction box using two screws. Thereafter, a first part of the lighting fixture, such as a pan or a housing, is attached to the fixture bar using at a minimum two screws, and/or a nipple and a nut. When the lighting fixture has a separate electrical chassis, an additional step would be required to attach it to the housing. Wiring connections are then made, followed by a second part of the lighting fixture or lens cover being secured to the first part with screws. An installation method simplifying or eliminating any step would represent significant time savings in commercial and industrial applications. Since the present invention combines the above-referenced second and fourth installation steps into one simplified step of pushing a clutch plate over a probe, it would provide substantial labor savings over the industry standard installation method for lighting fixtures now used. Further, when lighting fixtures with two 2-pin compact fluorescent lamps are used with the present invention and connected in parallel to a single power supply ballast, only one lamp will operate at a time due to the starting characteristics of the compact fluorescent lamp, resulting in lighting fixture operation for a period of approximately six years before re-lamping would be required. Therefore, when the present invention is utilized with compact fluorescent lamps, not only is installation time considerably reduced, but maintenance time would be substantially reduced as well. No device is known that has all of the advantages of the present invention.

SUMMARY OF INVENTION—OBJECTS AND ADVANTAGES

The primary object of this invention is to provide a means for reducing the time required for the installation of wall-mounted and ceiling-mounted lighting fixtures. It is also an object of this invention to simply the installation process for lighting fixtures by reducing the number of steps involved. A further object of this invention is to provide a means for reducing the number of parts used during installation of lighting fixtures. It is also an object of this invention to provide a twofold advantage by saving time on initial installation of a lighting fixture, and then to eliminate at least the first re-lamping function in the life of the fixture so as to provide a fixture that is essentially maintenance-free for the first six years of its life. A further object of this invention is to provide a means for the installation of lighting fixtures that protects the fixture from nuisance-causing materials, such as insects, dirt, and water. It is also an object of this invention to provide a means for preventing misalignment of an installed lighting fixture relative to its mounting surface. A further object of this invention is to provide a means for the installation of lighting fixtures that is cost efficient for widespread use.

As described herein, properly manufactured and installed, the present invention would enable fully assembled lighting fixtures to be installed much more rapidly than the time required for installation of installing ceiling-mounted and wall-mounted lighting fixtures using the industry standard method commonly employed today. While the industry-standard method involves a wide-ranging and variable number of installation steps, the present invention requires only three, resulting in a substantial reduction of on-site labor cost for commercial and industrial applications. Removal of a lighting fixture installed with the present invention is also prompt and easy to accomplish. Since the present invention uses a clutch ring secured within the back surface of the lighting fixture requiring installation, and once wiring terminations have been made, only four additional components are needed to achieve installation using an existing junction box, the four additional components being a probe, a fixture bar to support the probe, and two screws used to attach the fixture bar to the junction box. In contrast, the industry standard installation method at a minimum requires a fixture bar, two screws to attach the fixture bar to the junction box, a housing or pan for support of one or more lamps, a nipple, a nut to secure the housing or pan to the nipple, a lens, and at least two screws to secure the lens to the housing or pan and the handling of a number of loose components on the job site. Optionally the industry standard installation method may also require a chassis within the housing for lamp support and two additional screws to attach the chassis to the housing, as well as use of a washer in addition to the nipple and nut. The present invention uses pre-assembled lighting fixtures, which eliminates the step of on-site connection of lens and housing or pan. The present invention also simplifies the step of connecting the housing or pan to the fixture bar, whereby connection is achieved through a simple pushing of the clutch ring on the back of the housing or pan over the probe. Gasket material can be used adjacent to the clutch ring and around the back perimeter of the housing or pan to assist in sealing the central aperture in the clutch ring against entry of insects, dirt, and water. When such gasket material is used and compressed between the housing or pan and the respective wall or ceiling to which it is attached, the gasket material also prevents the lighting fixture from rotating on the probe and becoming misaligned relative to the mounting surface to which it is attached. Labor for both installation and maintenance can be substantially reduced for commercial and industrial applications when the present invention is used with lighting fixtures having two 2-pin compact fluorescent lamps that are connected in parallel to one power supply ballast. Due to the starting characteristics of the compact fluorescent lamp and the fact that the lamps intermittently alternate in use with only one lamp operating at a time, the typical period of lighting fixture operation without re-lamping is expected to exceed six years. To remove a lighting fixture installed with the present invention, one must separate the lens from the housing or pan. Then, with a screwdriver inserted into the slot in the distal end of the probe, and counterclockwise rotation applied, the probe can be promptly removed from the fixture bar, after which the probe can be forced from the clutch ring using pliers or another hand tool. No device is known with all of the advantages of the present invention.

The description herein provides the preferred embodiment of the present invention but should not be construed as limiting the scope of the lighting fixture attachment invention. For example, variations in the length and thickness dimensions of the probe; the size of the bores through the fixture bar and clutch plate; the depth of the slot in the distal end of the probe; and the configuration and dimension of the clutch plate; other than those shown and described herein may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 1:
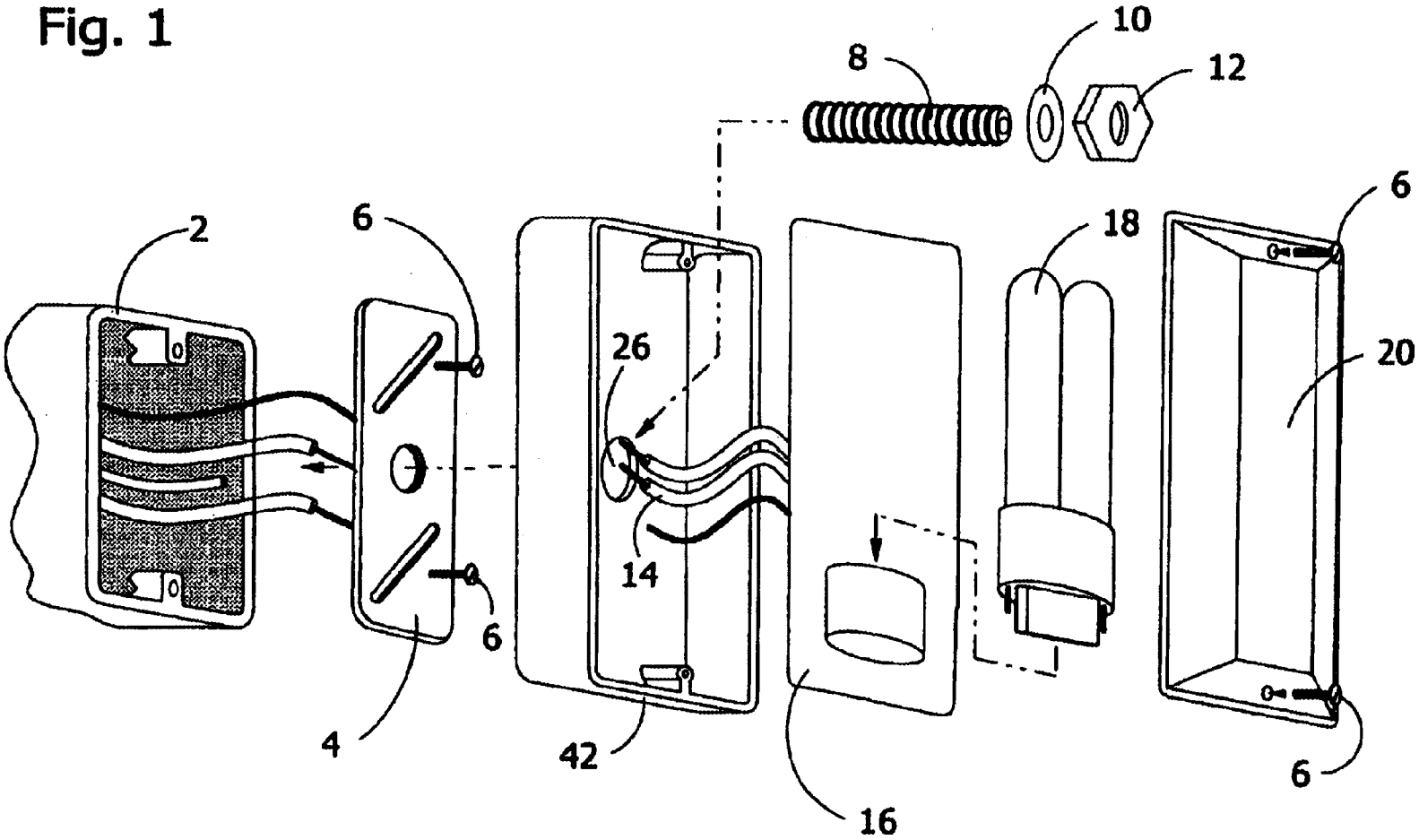
Fig. 1 PRIOR ART
FIG. 1 is an exploded view of the industry standard method for wall-mounted installation of a lighting fixture.
Figure 2:
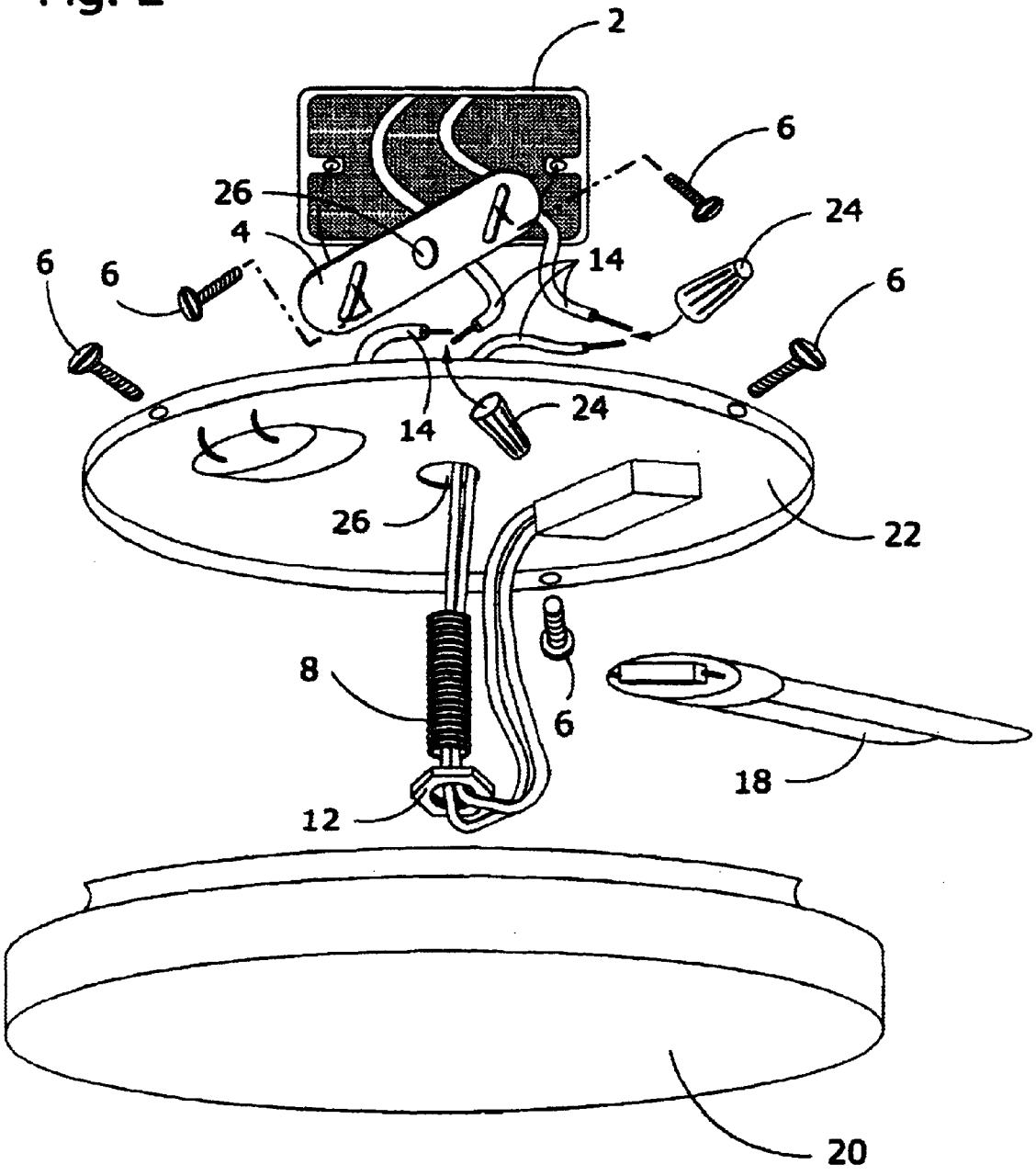
FIG. 2 is an exploded view of the industry standard method for ceiling-mounted installation of lighting fixture.

FIGS. 1 and 2 respectively show the industry standard methods for wall-mounted and ceiling-mounted installation of lighting fixtures, which is less cost effective than the present invention since the industry standard methods require more steps, more parts, and more on-site labor. FIG. 1 shows a fixture bar 4 poised in front of a junction box 2, and ready for attachment to junction box 2 through the use of two screws 6. Fixture bar 4 has two laterally positioned elongated slots32 and a hole 26 longitudinally centered between elongated slots 32, which are identified by number in FIG. 3. FIG. 1 further shows a housing 42 positioned next adjacent to fixture bar 4, with a central hole 26 through which nipple 8 is inserted and secured by washer 10 and nut 12. As shown by interconnected arrows in FIG. 1, it is contemplated for nipple 8 to be inserted through the central hole 26 in housing 42, through the central hole 26 in fixture bar 4, and connected via threaded attachment to the central portion of junction box 2. In the prior art method shown in FIG. 1, it is contemplated for the three wires 14 required for electrical connection of lamp 18 to also be inserted through the central hole 26 in housing 42. Next adjacent to housing 42, FIG. 1 shows a chassis 16 adapted for connection and support of lamp 18. The dimension and configuration of chassis 16 are dictated by that of housing 42, since it is contemplated for chassis 16 to fit inside of and be supported within housing 42. FIG. 1 also shows two screws 6 being used to secure chassis 16 within housing 42. FIG. 1 finally shows lens 20 next adjacent to lamp 18, with two additional screws 6 being used to secure lens 20 in place over lamp 16, chassis 18, and the front opening of housing 42. As a result, when a chassis is used, a person performing the lighting fixture installation must complete at least five steps, six steps if lamp 18 must be attached to chassis 16. A first step would logically be the connection of fixture bar 4 to junction box 2. Then wires 14 extending from the back of chassis 16 must be inserted through central hole 26 in housing 42 and connected via push plugs 24, shown in FIG. 2 to corresponding wiring in junction box 2. The third step would be connection of housing 42 to fixture bar 4 using nipple 8, washer 10, and nut 12. The fourth step would be the securing of chassis 16 within housing 42 using screws 6, with the fifth step being the connection of lens 20 over lamp 18 with additional screws 6. FIG. 2 shows a similar five-step process for ceiling-mounted lighting fixture installation. A first step would comprise the connection of fixture bar 4 to junction box 2 with the use of screws 6. Wires 14 extending from the back of chassis 16 would then be connected via push plugs 24 to corresponding wiring in junction box 2. Thereafter, nipple 8 and nut 12 would be used to secure pan 22 to the central hole 26 in fixture bar 4, followed by the final steps of attaching lamp 18 and lens 20 to pan 22, with lens 20 being secured against pan 22 by use of screws 6. Since no chassis 16 is used in FIG. 2, the step of attaching lamp 18 to pan 22 would have to be performed after nipple 8 is used to secure pan 22 to fixture bar 4, as a result of the location of hole 26 beneath the operating position of lamp 18.

Figure 3:
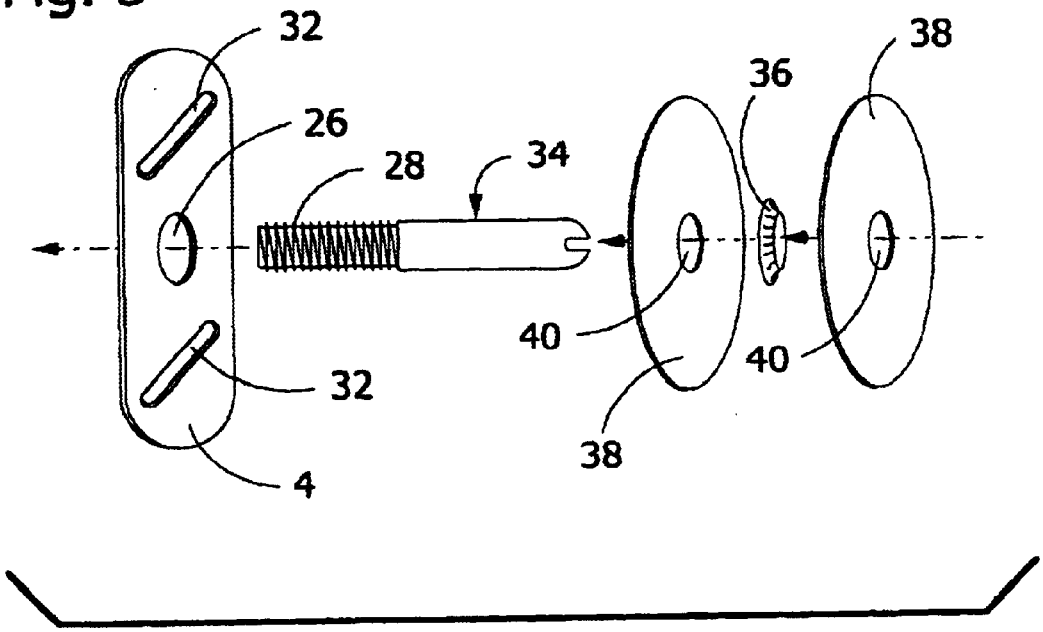
FIG. 3 is an exploded view of the clutch ring, probe, and fixture bar used in the most preferred embodiment of the present invention for mounting a lighting fixture.
Figure 4:
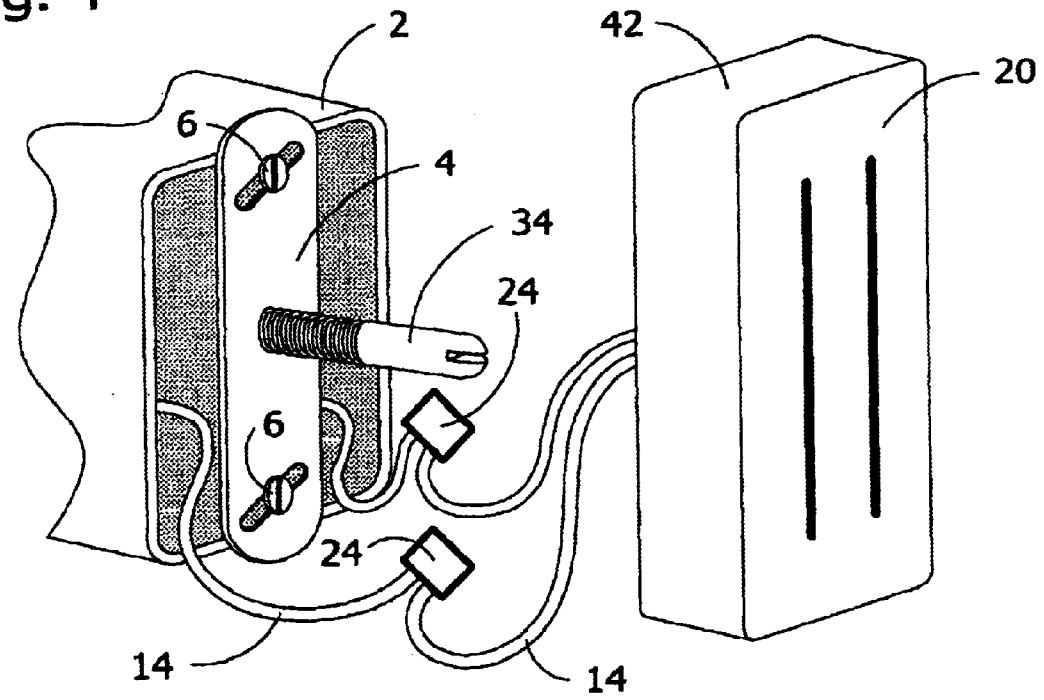
FIG. 4 is a perspective view of a lighting fixture being wall-mounted through use of the most preferred embodiment of the present invention, prior to the clutch ring on the back of the lighting fixture housing being pushed over the probe.
Figure 5:
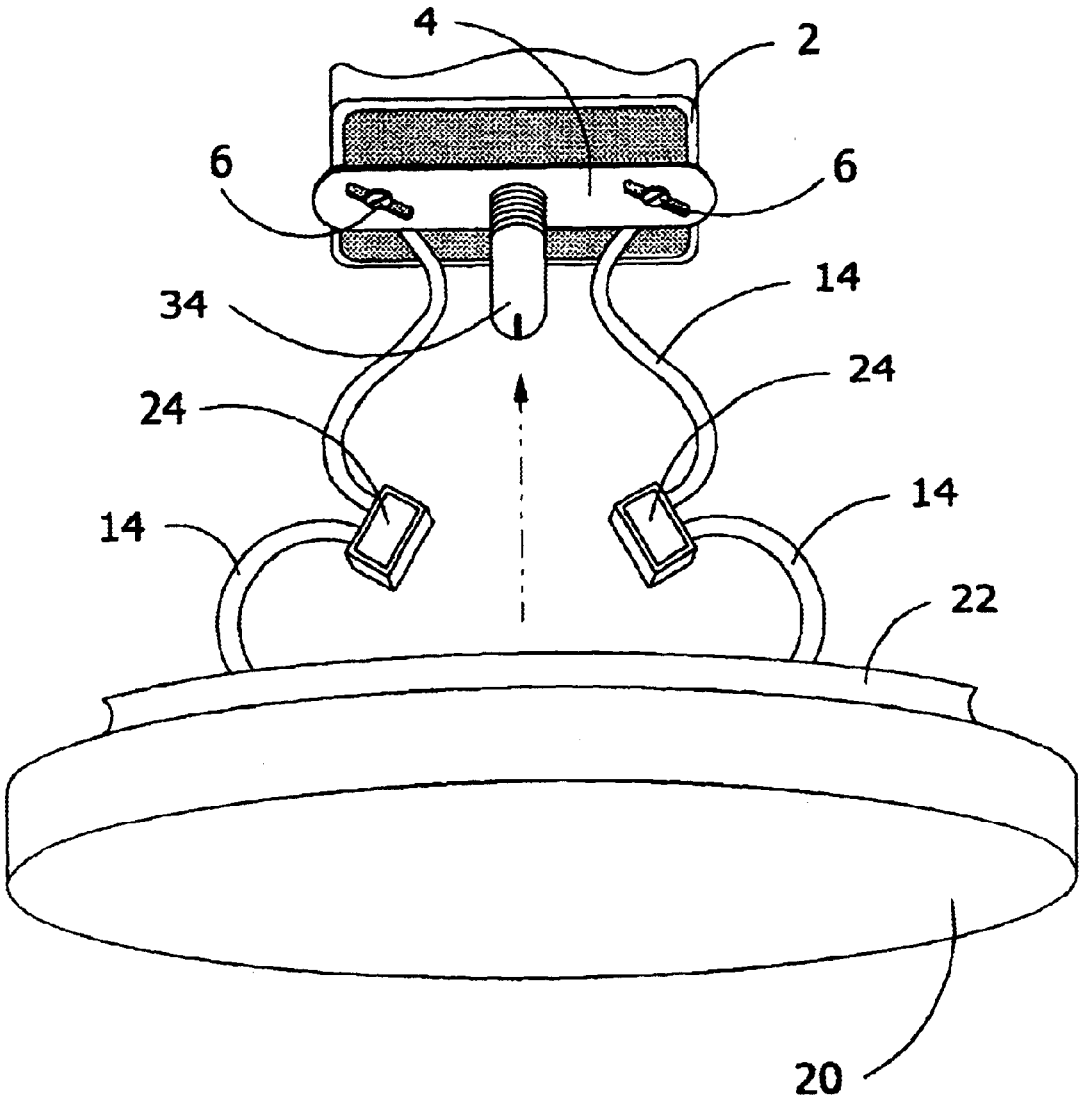
FIG. 5 is a side view of a lighting fixture being ceiling-mounted through use of the most preferred embodiment of the present invention, prior to the clutch ring on the back surface of the lighting fixture pan being pushed over the probe.

FIGS. 3, 4, and 5 show the probe 34 and fixture bar 4 used in the most preferred embodiment of the present invention for wall-mounted or ceiling-mounted lighting fixture installation. FIG. 3 also shows the clutch ring 36 and one embodiment of the clutch ring retainers 38 that remain hidden on the back surfaces respectively of housing 42 and pan 22 in FIGS. 4 and 5. FIG. 3 shows fixture bar 4 having two spaced-apart elongated slots 32, each at approximately the same oblique angle relative to the opposing side edges of fixture bar 4. A hole 26 is longitudinally centered between elongated slots 32. Elongated slots 32 are configured for adjustability in securing probe 34 within a variety of junction boxes 2. FIG. 3 also shows probe 34 having opposing ends, with a distal end slot 30 on one end and a threaded configuration 28 on its opposite end. Threads 28 must securely fix probe 34 within central hole 26. Also, distal end slot 30 must be of a size and configuration appropriate for insertion of a screwdriver (not shown) for counterclockwise rotation of probe 34 that ultimately releases probe 34 from its fixed attachment to fixture bar 4 and allows removal of the lighting fixture from its installed location. Initially after removal from such a wall-mounted or ceiling-mounted position, the slotted distal end 30 of probe 34 remains inserted through the central aperture 40 in clutch ring 36. A pair of pliers or other hand tool (not shown) would be required to draw probe 34 completely through clutch ring 36 in the same direction as originally inserted. Probe 34 can then be reattached to fixture bar 4, as needed for subsequent installations. The length of probe 34 would depend on the configuration and dimension of the lighting fixture intended for mounting thereon. If needed during installation, adjustability could be accomplished by removing a portion of threads 28 from probe 34, or inserting additional clutch retainers 38 between clutch ring 36 and the back surface of pan 22 or housing 42. The configuration of clutch retainers 38 is not critical, and it is considered to be within the scope of the present invention to include clutch retainers 38 having other dimensions and configurations, including a clutch ring 36 and clutch retainer 38 formed from a single piece of material. For example, the clutch retainers 38 in FIGS. 6 and 7 exhibit a substantially rectangular configuration. FIG. 4 shows a lighting fixture in the process of being wall-mounted through use of the present invention. Fixture bar 4 is connected to junction box 2 with two screws 6 and probe 34 is secured centrally to fixture bar 4 in a substantially perpendicular position relative to fixture bar 4. The opposing ends of fixture bar 4 project beyond the wall or ceiling opening into which junction box 2 is positioned to rest upon the wall or ceiling material (not shown) surrounding junction box 2 to assist in preventing inward movement of junction box 2 as clutch ring 36 is being slid over probe 34. Wiring terminations have been made for wires 14 via push plugs 24, and the factory assembled housing 42 and lens 20, with a hidden clutch ring 36 on the back of housing 42, are poised and ready to be pushed over the slotted distal end 30 of probe 34. As can be better observed in FIG. 3, clutch ring 36 comprises a plurality of incisions made around aperture 40, with aperture 40 within clutch ring 36 being slightly smaller in diameter than the cross-sectional dimension of probe 34, so that when the slotted distal end 30 of probe 34 is forced through aperture 40 in clutch ring 36, the incisions become enlarged and adjacent portions of clutch ring 36 become separated from one another. Care must be taken to maintain wires 14 and push plugs 24 behind housing 24 or pan 22. Once probe 34 has attained its position of farthest insertion within clutch ring 36, lens 20 and either housing 42 or pan 22 are in their operating positions. Should a withdrawal force be applied to housing 20 or pan 22, the unrefined ends of the separated portions of clutch ring 36 would take hold of and grip into the outer surface of probe 34, preventing the intended withdrawal from being easily accomplished. For prompt separation of housing 42 or pan 22 from fixture bar 4, one would remove lens 20, apply the tip of a screwdriver (not shown) to the slotted distal end 30 of probe 34, rotate probe 34 in a counterclockwise direction until probe 34 is released from fixture bar 4, and then using a pair of pliers or other hand tool force a release of probe 34 from the unrefined ends of the separated portions of clutch ring 36 holding the outer surface of probe 34. FIG. 5 shows a ceiling-mounted lighting fixture installation using the present invention, prior to the hidden clutch ring 36 secured through the back surface of pan 22 being pushed over the slotted distal end of probe 34. Fixture bar 4 is secured to junction box 2 with two screws 6. Lens 20 and pan 22 are factory assembled, and poised for installation as a unit over probe 34. FIG. 5 also shows a push plug 24 having a quick-insert configuration requiring no alignment of wires 14, or twisting of push plug 24 over wires 14 to establish electrical connection between them.

Figure 6:
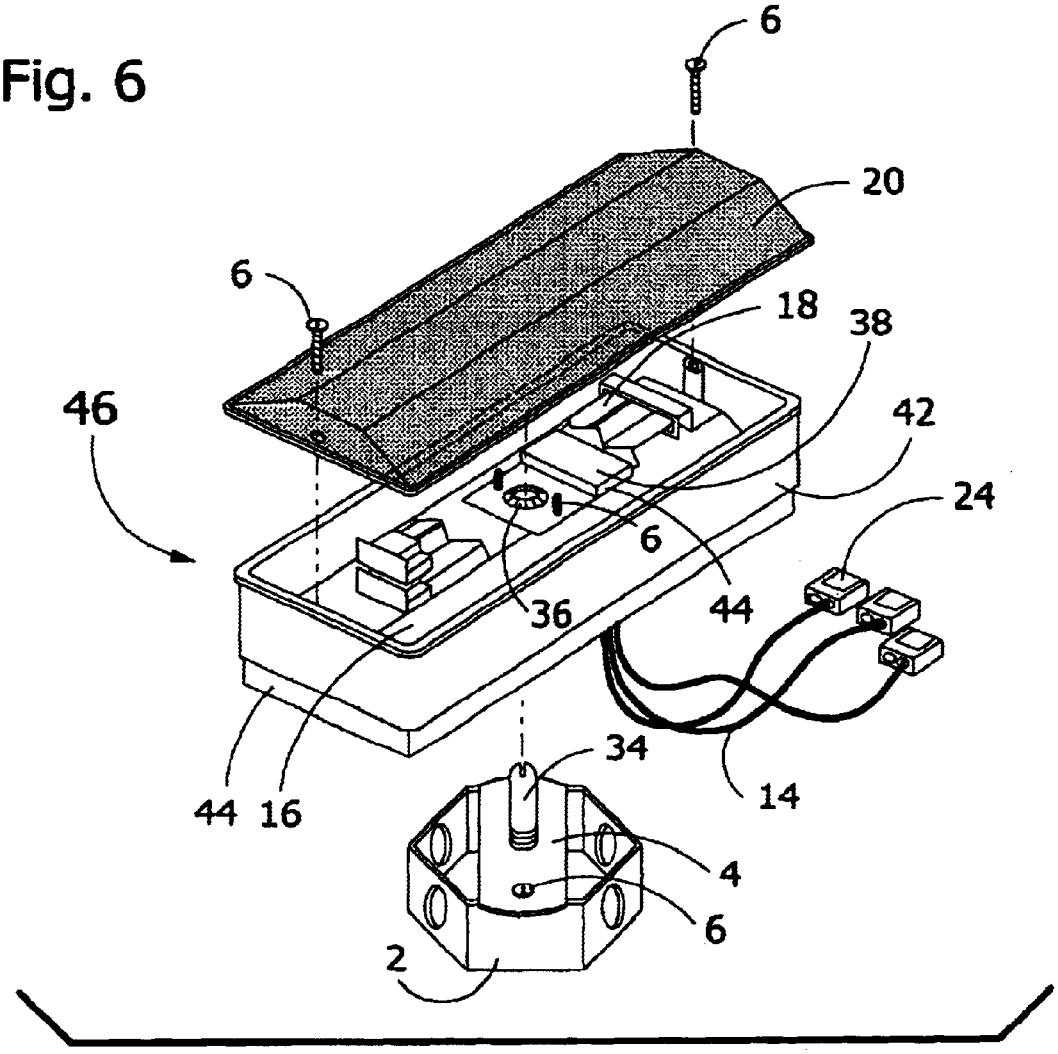
FIG. 6 is a perspective view of a lighting fixture with a housing, a lens, two lamps, three wires each having a distal push plug, and a chassis within the housing having a centrally located clutch retainer with a clutch ring, being aligned with a probe upwardly depending from a fixture bar attached to a junction box, with gasket material being positioned under the raised portion of the clutch retainer allowing for nuisance-free wire entry into the housing, and additional gasket material adjacent to the bottom perimeter of the housing.
Figure 7:
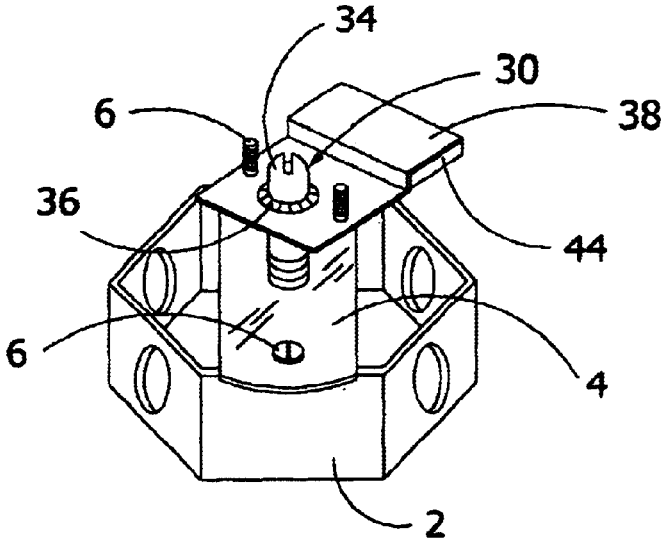
FIG. 7 is an enlarged perspective view of a fixture bar secured to a junction box with screws, a probe upwardly depending from the fixture bar and being substantially perpendicular to the fixture bar, the slotted distal end of the probe extending through a clutch ring positioned within a clutch retainer, additional screws extending through the clutch retainer for chassis attachment, and a quantity of gasket material positioned under a raised portion of the clutch retainer.

FIG. 6 shows a compact fluorescent lighting fixture 46 with a housing 42, a lens 20, two 2-pin compact fluorescent lamps 18, three wires 14 each having a distal push plug 24, and a chassis 16 within housing 42 having a centrally located clutch retainer 38 with a clutch ring 36, being aligned with a probe 34 upwardly depending from a fixture bar 4 attached to a junction box 2, with gasket material 44 being positioned under the raised portion of clutch retainer 38 and allowing for nuisance-free entry of wires 14 into housing 42, and additional gasket material 44 positioned adjacent to the bottom perimeter of housing 42. In contrast, FIG. 7 shows an enlarged view of the fixture bar 4 being secured to junction box 2 with screws 6, probe 34 upwardly depending from fixture bar 4 and being substantially perpendicular to fixture bar 4, the slotted distal end 30 of probe 34 extending through clutch ring 36 centrally positioned within one portion of a clutch retainer 38, additional screws 6 extending through clutch retainer 38 for attachment of clutch retainer 38 to chassis 16, and a quantity of gasket material 44 positioned under a raised portion of clutch retainer 38 for securing against unwanted pests, moisture, and debris, (not shown) the opening (not shown) in housing 42 through which wires 14 would extend for electrical connection to lamps 18. This is a difference from the prior art, whereby if a chassis 16 is used, wires 14 extend through aperture 40 along with nipple 8. However, in the present invention, the unrefined ends of the separated portions of clutch ring 36 around is central aperture must securely grip into the outer surface of probe 36. As a result, when a chassis 16 is used with the present invention, a separate hole 26 is needed through the bottom surface of housing 42 for the extension of wires 14. Also, the gasket material 44 adjacent to the bottom perimeter of housing 42 serves a dual purpose. In addition to minimizing the intrusion of nuisance-causing materials (not shown), such as but not limited to insects, dirt, and water, gasket material 44 also provides a means of preventing the fixture from rotating on probe 34 and thus becoming misaligned with its mounting surface (not shown).

Thus, the present invention provides improved, cost-saving installation of wall-mounted and ceiling mounted lighting fixtures. However, when the present invention is combined with the low-wattage 2-pin compact fluorescent lamps 18 shown in FIG. 6, maintenance of the installed light fixtures is also improved by eliminating at least the first re-lamping function to provide a lighting fixture that is maintenance-free for a minimum period of six years. Thus, the preferred method of lighting fixture installation shown in FIG. 6 allows a lighting fixture to be completely assembled at the factory, using factory labor instead of less efficient on-site installation labor, and further utilizes an operating characteristic of 2-pin compact fluorescent lighting that allows the installation of multiple lamps in the lighting fixture, which intermittently alternate in use with only one lamp operating at a time, to extend the time period between lamp changes. A brief summary of the industry standard and present methods of light fixture installation are provided below for comparison, using the illustration in FIG. 6 for reference.

The industry standard method of installing housing 42 and lens 20 involves the fastening of fixture bar 4 to the tapped holes provided in the corners of a wall or ceiling mounted junction box 2. Fixture bar 4 is adapted for receiving a threaded 1/8-inch pipe-size nipple 8, which provides the attachment means for the lighting fixture assembled on-site from housing 42, lamps 18, and lens 20. Electrical supply wires 14 are either run thorough pipe nipple 8 to supply electricity to the lamps 18 supported within housing 42, or in the alternative electrical supply wires 14 can be run adjacent to nipple 8 for termination with the supply wires 14 used to service lamp 18. Housing 42 is then held close in proximity to pipe nipple 8 and wiring terminations are made using twist/push plugs 24 or other effective termination means. In the alternative, if support of lamps 18 is provided in the form of a separate chassis 16, wiring terminations will be made in a subsequent step, after housing 42 is connected to junction box 2. Housing 42 is then slid over pipe nipple 8 and a locknut 12 is threaded into position and tightened to secure housing 42 against the wall or ceiling containing the junction box 2 to which fixture bar 4 has been affixed. At this time, if there is a separate chassis 16, the chassis 16 is held in place against housing 42, wiring terminations are made with twist/push plugs 24 or other effective termination means, and after terminations are made, screws 6 are used to affix chassis 16 to housing 42. Lamps 18 are then mounted upon chassis 16, followed by attachment of lens 20, or a lens-cover combination, to housing 42 with additional screws 6.

In contrast, to install the lighting fixture shown in FIG. 6 using the present invention, two screws 6 and a single piece of loose hardware in the form of a fixture bar 4 and shaft or probe 34 are employed, with the shaft or probe 34 projecting at right angles to the flat plane of fixture bar 4. After fixture bar is attached to a junction box 2 with screws 6, the factory-assembled housing 42, lamps 18, and lens 20 combination, is simply mated to shaft or probe 34 by pushing the clutch ring 36 attached centrally to the back surface of housing 42 over shaft or probe 34 until the back surface of housing 42 is firmly positioned against a wall or ceiling surface. Gasket material 44 can be secured to the back surface of housing 42, preferably adjacent to the perimeter edges of its back surface, for additional fortification between housing 42 and the ceiling or wall supporting it, and as a defense measure against insects, dirt, water and other undesirable nuisance-causing materials. Although not limited thereto, it is preferred for fixture bar 4 to be fabricated from plastic or metal of sufficient gauge to withstand the rigors of fixture installation. The shaft or probe 34 must have a sufficient cross-section so as to be adequately gripped by the locking fingers of clutch ring 36. The shaft or probe 34 may be of smooth construction. In the alternative, shaft or probe 34 may have circumferential rings impressed on it in a manner similar to compression threading or it may be a threaded stud. Also, fixture bar 4 may have the shape of a conventional fixture bar, or its flat surface may extend sufficiently to allow it to project over junction box 2 and actually cover some of the wall or ceiling surface against which housing 42 will be installed. This projection would keep fixture bar 4 from pressing inwardly against junction box 2 when the clutch ring 36 attached to the back surface of the factory-assembled combination of housing 42, lamps 18, and lens 20 is slid over shaft or probe 34 during installation.

For industry standard installation, housing 42 has a centrally located clearance hole 26 through which pipe nipple 8 is allowed to extend. For the present invention, this same clearance hole 26 is provided, however, it a clutch retainer 38 having an aperture 40 is also aligned with clearance hole 26 and attached over it. Clutch retainer 38 is substantially a flat piece of material, typically tempered steel, which has an aperture 40 pierced through it to allow passage of shaft or probe 34. Extending inwardly into aperture 40 are multiple fingers, which have been left in place during the piercing operation used to create aperture 40, with the purpose of these fingers being to grip the outer surface of the shaft or probe 34 while it is in its operational position outwardly extending from fixture bar 8 and junction box 2. The fingers projecting into aperture 40 have a length dimension that is a fraction of the diameter dimension of aperture 40, and become bent or upset in the direction that shaft or probe 34 is inserted. The purpose of the upsetting of the fingers is to allow easy ingress of shaft or probe 34 through aperture 40, but to dig into and grasp the surface of shaft or probe 34 should applied forces attempt to remove it from aperture 40 and cause separation of shaft or probe 34 from clutch retainer 38. The means for attachment of clutch retainer 38 to the inside back surface of housing 42 can include screws and rivets, or any other means considered to be appropriate to provide a secure connection therebetween. With clutch retainer 38 secured against the back inside surface of housing 42, and electrical wires 14 coming through a separate opening in the back surface of housing 42, preferably adjacent to clearance hole 26 and aligned aperture 40, the factory-assembled combination of housing 42, lamps 18, and lens 20, can be installed over the shaft or probe 34 outwardly depending from fixture bar 4 and junction box 2. The operation of installing the fixture is now reduced to three step, with the first step being the installation of the fixture bar 4 and shaft or probe 34 combination onto junction box 2; the second step being the connection of the three wires 14 coming from lamps 18 to the three wires 14 extending from junction box 2; and the third step being the pushing of the factory-assembled combination of housing 42, lamps 18, and lens 20, into its operational position over the mounting shaft or probe 34. Since housing 42, lamps 18, and lens 20 are pre-assembled during manufacture, with lamps 18 already in place, no other work is required on site from the installer. To further protect lamps 18 and wires 14 from the intrusion of insects, dirt, other debris, and water, all of which contribute to maintenance problems, the back outside surface of housing 42 may have installed on it gasket material 44 which will be compressed between housing 42 and the wall or ceiling against which housing 42 is mounted. However, the use of gasket material 44 is not critical. In addition to preventing intrusion of nuisance-causing materials, this use of gasket material 44 will provide a means of preventing rotation of housing 42 on shaft or probe 34 and thus becoming misaligned with the ceiling or wall surface to which housing 42 is mounted. Additional gasket material 44 can also be situated for similar purposes between clutch retainer 38 and the inside back surface of housing 42, adjacent to the opening through which wires 14 would extend to reach the wires 14 in junction box 2 for termination therewith. Although gasket material 44 may comprise a foam with memory that will push back to maintain a good seal between the back outside surface of housing 42 and the ceiling or wall to which it is mounted, other materials are also considered to be within the scope of the present invention. When two 2-pin fluorescent lamps 18 are connected electrically in parallel to a single power supply ballast, only one lamp will operate because of the starting characteristics of the compact fluorescent lamp. Also, two independently powered ballasts could be used, so that if one failed, the other would maintain lamp operation. Compact fluorescent lamps have a rated life cycle of 10,000 hours. Therefore, with two lamps 18 mounted within housing 42, with only one burning at a time in accordance with the above-outlined installation, a total operation time of 20,000 hours would be expected. Based upon an average of 3600 burning hours per year, the fixture should operate for a minimum of six years before re-lamping becomes necessary. Therefore, if two lamps 18 are installed in housing 42, and they are connected as described above, lens 20 would not have to be removed from housing 42 for six years, and the factory seal will remain unbroken during that entire six-year period of time. As a result, the present invention provides easy, cheap installation, substituting more efficient factory labor for on-site installation labor. Also, when two compact fluorescent lamps 18 and one ballast are used, one would expect as much as eight years of light without re-lamping. Also, replacement of lamps 18 is by conventional means, whereby using screws 6 lens 20 is removed, the spent lamp 18 is withdrawn from its mounted position, a replacement lamp 18 is substituted for the spent lamp 18, and lens 20 is replaced and secured again with screws 6. Thus, for a period of six to eight years no maintenance would be expected, and when lamp replacement is finally require, such replacement is prompt and uncomplicated. Further, should replacement of housing 42 and lens 20 be desired for any reason, removal from a wall or ceiling surface is also prompt and uncomplicated. Screws 6 would be loosened or removed to allow separation of lens 20 from housing 42. Lamps 18 would then need to be removed from their mounted positions to expose the slotted distal end 30 of shaft or probe 34 extending through clutch ring 36. Once slot 30 is accessible, the tip of a screwdriver can be inserted into slot 30 and rotated counterclockwise to cause shaft or probe 34 to become withdrawn from hole 26 in fixture bar 4, and once shaft or probe 34 is separated from fixture bar 4, housing 42 is released from its mounted position against the ceiling or wall.

Additionally, although not mentioned in the discussion above, the present invention contemplates the necessity of adjusting the projection length of shaft or probe 34 beyond the face of fixture bar 4, to insure successful support of housing 42 or pan 22 against the wall or ceiling surface to which mounting is intended. An installer preparing to mount a housing 42 and lens 20 with which he or she has no prior installation experience, might use a gauge to determine the proper projection length of shaft or probe 34. As a further alternative to shaft or probe 34, and although not shown, the present invention further contemplates the use of a large headed screw in place of shaft or probe 34. Then for removal of housing 42 from its mounted position against a ceiling or wall surface, one would simply have to cut the head off of the screw and pull housing 42 away from fixture bar 4, leaving the remaining portion of the large headed screw still attached to fixture bar 4. Further securing of shaft or probe 34, or the large headed screw (not shown), and adjustment of the projection length, could be accomplished through use of a wedge aligned longitudinally or transversely with shaft or probe 34, or the large headed screw. When longitudinal positioning is used, shaft or probe 34, or the large headed screw, would be inserted through the wider end of the wedge. The materials from which the wedge is made are not limited and can include any material within which shaft or probe 34, or the large headed screw, could remain firmly fixed once installed. In the most preferred embodiment of the present invention, the wedge would be made from plastic.

What is claimed is:

1. Apparatus for mounting a factory-assembled lighting fixture over a junction box in a ceiling or wall, said apparatus comprising:

fixture bar means;

probe means adapted for substantially perpendicular engagement with said fixture bar means;

a clutch retainer having a clutch ring; and a plurality of screws whereby when said fixture bar means is secured with said screws to the junction box in a ceiling or wall, and said clutch retainer is factory assembled through the back of a lighting fixture, following alignment of said probe means with said clutch ring, the intact lighting fixture can be pushed against said perpendicularly positioned probe means until the lighting fixture is positioned firmly against the ceiling or wall for immediate mounting against the ceiling or wall into which the junction box in located.

2. The apparatus of claim 1 wherein said fixture bar means is adapted to extend beyond the junction box.

3. The apparatus of claim 1 wherein said probe means is selected from a group consisting of probes, shafts, probes having a slotted distal end, probes having a slotted distal end and an opposing threaded end, and large headed screws.

4. The apparatus of claim 1 wherein said probe means is further secured to said fixture bar means with a wedge.

5. The apparatus of claim 1 further comprising a quantity of gasket material secured between the lighting fixture and the mounting surface to which the lighting fixture is being installed.

6. The apparatus of claim 1 wherein the lighting fixture has a lamp wiring exit hole, and further comprising a quantity of gasket material secured between said clutch retainer and the lighting fixture, said gasket material being adapted to protect the lamp wiring exit hole from intrusion of nuisance-causing materials.

7. The apparatus of claim 1 further comprising a lighting fixture having compact fluorescent lighting.

8. The apparatus of claim 7 wherein said lighting fixture is selected from a group consisting of lighting fixtures having two 2-pin compact fluorescent lamps connected in parallel to one ballast, and lighting fixtures having two 2-pin compact fluorescent lamps and two ballasts.

9. Apparatus for mounting a factory-assembled lighting fixture over a junction box in a ceiling or wall, said apparatus comprising:

a fixture bar configured for support by the junction box;

a probe having a slotted distal end and being adapted for substantially perpendicular engagement with said fixture bar;

a clutch retainer having a clutch ring; and a plurality of screws whereby when said fixture bar is secured with said screws to the junction box, and said clutch retainer is factory assembled through the back of a lighting fixture, following alignment of said slotted distal end of said probe with said clutch ring, the intact lighting fixture can be pushed over said distal end until the lighting fixture is positioned firmly against the ceiling or wall for immediate mounting against the ceiling or wall into which the junction box in located.

10. The apparatus of claim 9 wherein said fixture bar is adapted to extend beyond the junction box.

11. The apparatus of claim 9 wherein said probe is further secured to said fixture bar with a wedge.

12. The apparatus of claim 9 further comprising a quantity of gasket material secured between the lighting fixture and the mounting surface to which the lighting fixture is being installed.

13. The apparatus of claim 9 wherein the lighting fixture has a lamp wiring exit hole, and further comprising a quantity of gasket material secured between said clutch retainer and the lighting fixture, said gasket material being adapted to protect the lamp wiring exit hole from intrusion of nuisance-causing materials.

14. The apparatus of claim 9 further comprising a lighting fixture having compact fluorescent lighting.

15. The apparatus of claim 14 wherein said lighting fixture is selected from a group consisting of lighting fixtures having two 2-pin compact fluorescent lamps connected in parallel to one ballast, and lighting fixtures having two 2-pin compact fluorescent lamps and two ballasts.

16. A method for mounting a factory-assembled lighting fixture over a junction box in a ceiling or wall, said method comprising the steps of:

providing a fixture bar, a probe having a slotted distal end, a factory-assembled lighting fixture with a clutch retainer having a clutch ring, and a plurality of screws;

using said screws to attach said fixture bar to the junction box;

connecting said probe to said fixture bar so that said probe is substantially perpendicular to said fixture bar;

aligning said slotted distal end of said probe with said clutch ring; and pushing said factory-assembled lighting fixture over said distal end until the lighting fixture is positioned firmly against the ceiling or wall.

17. The method of claim 16 wherein said fixture bar is adapted to extend beyond the junction box.

18. The method of claim 16 further comprising the steps of providing a wedge and securing said probe to said fixture bar with said wedge.

19. The method of claim 16 wherein the lighting fixture has a lamp wiring exit hole, and further comprising the steps of providing a quantity of gasket material, securing said gasket material between the lighting fixture and the mounting surface to which the lighting fixture is being installed, and securing a portion of said gasket material between said clutch retainer and the lighting fixture, said gasket material being adapted to protect the lamp wiring exit hole from intrusion of nuisance-causing materials.

20. The method of claim 16 wherein said lighting fixture is selected from a group consisting of lighting fixtures having two 2-pin compact fluorescent lamps connected in parallel to one ballast, and lighting fixtures having two 2-pin compact fluorescent lamps and two ballasts.

* * * * *